US009846008B1

(12) United States Patent
DiLeo

(10) Patent No.: US 9,846,008 B1
(45) Date of Patent: Dec. 19, 2017

(54) HOLSTER

(71) Applicant: Michael C. DiLeo, Brookhaven, NY (US)

(72) Inventor: Michael C. DiLeo, Brookhaven, NY (US)

( * ) Notice: Subject to any disclaimer, the term of this patent is extended or adjusted under 35 U.S.C. 154(b) by 0 days.

(21) Appl. No.: 15/366,911

(22) Filed: Dec. 1, 2016

Related U.S. Application Data

(60) Provisional application No. 62/344,228, filed on Jun. 1, 2016.

(51) Int. Cl.
*F41C 33/00* (2006.01)
*F41C 33/04* (2006.01)
*F41C 33/02* (2006.01)

(52) U.S. Cl.
CPC ..... *F41C 33/046* (2013.01); *F41C 33/0209* (2013.01)

(58) Field of Classification Search
CPC ..... F41C 33/02; F41C 33/0209; F41C 33/00; A45F 5/00; A45F 3/50
USPC ..... 224/222, 198, 911
See application file for complete search history.

(56) References Cited

U.S. PATENT DOCUMENTS 2,459,992 A * 1/1949 Cimino ..... A45C 3/14 2/59
2,810,132 A * 10/1957 Nicholson ..... A41D 13/0012 2/247
3,322,311 A * 5/1967 Homer ..... A45F 5/00 224/222
4,029,242 A 6/1977 Stoesser
4,410,118 A * 10/1983 Taurisano ..... A45F 5/00 224/192
4,625,340 A * 12/1986 Hernandez ..... A41D 27/20 2/247
4,856,112 A * 8/1989 Effle ..... A41D 13/08 2/16
4,951,317 A * 8/1990 Gray ..... A41D 13/06 2/16
5,058,788 A * 10/1991 Newmark ..... A45F 5/00 224/198
5,148,949 A * 9/1992 Luca ..... A01K 27/006 222/175

(Continued)

FOREIGN PATENT DOCUMENTS

SL 200350102 5/2003
WO 2006015883 2/2006
WO 2016033309 3/2016

OTHER PUBLICATIONS

AlphaHolster; Thigh Gun Holster; www.amazon.com; Dec. 8, 2016.

(Continued)

*Primary Examiner* — Brian D Nash
(74) *Attorney, Agent, or Firm* — Gottlieb, Rackman & Reisman, P.C.

(57) ABSTRACT

A holster for carrying a concealed weapon in an area of a body between a knee and an ankle. The holster includes a sleeve that has a non-uniform circumference defining a shape contoured to substantially encompass the lower leg of an individual, a closure mechanism that is fixed to the sleeve and configured to allow for expansion and compression of at least part of the sleeve and a pocket that is fixed to the exterior of the sleeve and that is shaped to carry a weapon therein.

18 Claims, 7 Drawing Sheets

(56) References Cited

U.S. PATENT DOCUMENTS 5,187,813 A * 2/1993 Klein ..... A41D 13/08 2/16
5,215,238 A * 6/1993 Baruch ..... F41A 17/54 224/243
5,400,936 A * 3/1995 Jones ..... A45C 1/04 224/219
5,445,303 A * 8/1995 Cawile, Jr. ..... F41C 33/00 224/222
5,477,633 A * 12/1995 Leinberger ..... G09F 3/005 2/16
5,568,889 A * 10/1996 Holloway, Jr. ..... B25H 3/00 224/222
5,642,525 A * 7/1997 Ketola ..... A41D 13/08 2/16
5,868,652 A * 2/1999 Spletzer ..... A63B 21/0605 2/22
5,956,883 A * 9/1999 Krouth ..... A01K 97/10 224/922
5,988,467 A 11/1999 Brustein
6,092,235 A * 7/2000 Santa Cruz ..... A41D 13/08 2/125
6,357,639 B1 * 3/2002 Williams ..... A01K 97/10 224/200
6,443,341 B1 * 9/2002 Rittmann ..... A45C 1/04 150/149
6,472,590 B1 * 10/2002 Kulik ..... G10D 3/00 2/16
6,685,066 B2 * 2/2004 Cragg ..... A45F 5/021 224/192
6,695,704 B2 * 2/2004 Parsons ..... F41C 33/02 224/914
D586,553 S * 2/2009 Kiss ..... D3/224
7,725,950 B2 * 6/2010 Hinebaugh ..... A41D 13/08 2/16
9,149,073 B1 * 10/2015 Hirshberg ..... A41B 5/00
9,464,867 B2 * 10/2016 Thompson ..... F41C 33/0209
9,468,285 B2 * 10/2016 Martinez ..... A45F 5/02
2006/0011679 A1 * 1/2006 Santiago ..... B25H 3/00 224/222
2009/0314813 A1 * 12/2009 Woolery ..... A45F 5/02 224/183
2010/0059559 A1 * 3/2010 Given ..... A45F 5/00 224/222
2010/0200627 A1 8/2010 Shen
2010/0252590 A1 * 10/2010 Chan ..... A45F 5/00 224/191
2010/0311551 A1 * 12/2010 Winston ..... A63B 21/0605 482/105
2013/0098955 A1 * 4/2013 Lamey ..... A45F 5/00 224/222
2014/0158734 A1 6/2014 Bickert et al.
2015/0122861 A1 * 5/2015 Adams ..... F41C 33/0218 224/587
2015/0233670 A1 8/2015 Galoob
2016/0102940 A1 * 4/2016 Sykes ..... F41C 33/0236 224/587

OTHER PUBLICATIONS

Robert Tilford; Thread reveals policies and procedures vary concerning concealed weapons permit holders entering Air Force bases in America; www.groundreport.com; Mar. 13, 2014.
NIANPU; Ankle Holster+Concealed Carry; www.amazon.com; Dec. 8, 2016.
Garter Holster by CanCan Concealment; https://www.gungoddess.com/garter-holster/; Dec. 8, 2016.
Apache Ankle Rig for KELTEC P3AT RH; www.AllstatePolice.com; Dec. 8, 2016.

* cited by examiner

HOLSTER

CROSS-REFERENCE TO RELATED APPLICATION

This patent application claims benefit under 35 U.S.C. §119 to U.S. Provisional Patent Application No. 62/344,228, filed Jun. 1, 2016, which is hereby incorporated by reference in its entirety as part of the present disclosure.

FIELD OF THE INVENTION

The present disclosure relates generally to holsters and more specifically to a holster configured to be arrangeable on the lower leg of an individual to conceal a firearm.

BACKGROUND OF THE INVENTION

In general holsters, including holsters designed to carry a concealed weapon, such as a firearm, are known. Such holsters, for example, have been designed to fit on or around an individual's thigh, arm and ankle or attached to an individual's chest or waist. However, in many instances, due to the location of the holster, significant compromise is required for a holster to properly house a firearm and be easily accessible. Additionally, if the clothing article concealing the holster is, for example, short or tight, the intent of concealing the weapon will fail.

Holsters designed to be affixed to or encompass an individual's thigh (e.g., tactical holster) are limited in their scope of use when intended to be utilized to conceal a weapon. This is because they can typically only used by an individual wearing a dress or skirt or in some instances an overcoat because of limited ease of accessibility otherwise to the concealed firearm.

Ankle holsters are commonly secured around an individual's ankle and are orientated to hold a weapon in an upright position (i.e., zero cant position). However, in many instances ankle holsters cannot properly secure a firearm in a fixed position due to the lack of surface area and other physical attributes of a human ankle. As a result, ankle holsters regularly require the inclusion of a garter strap to help distribute the weight of a weapon up an individual's leg and onto the individual's calf. Additionally, due to the articulation of one's ankle when an individual moves, ankle holsters tend to be uncomfortable for active use. Furthermore, the position of ankle holsters are less than ideal for an individual desiring to carry a concealed weapon because they are commonly arranged in close proximately to the bottom of a clothing article and, regardless of whether an individual is moving or sitting, ankle holsters are commonly inadvertently revealed and fail to conceal the weapon being carried by the holster.

SUMMARY OF THE INVENTION

The present disclosure is directed to a holster designed to carry a concealed weapon that is configured to be arrangeable around the lower leg of an individual, between a knee and an ankle of the individual, at least substantially encompassing the individual's calf. The lower leg, offers substantial surface area to ergonomically confirm the shape of the holster to the lower leg and in turn arrange, in a stable manner, a weapon parallel to the individual's body. Such surface area obviates the need for garter-type arrangements necessitated by ankle holsters while allowing for easy access to a holstered weapon that can easily be concealed.

In an embodiment, the present invention is directed to a holster that comprises a sleeve that has a non-uniform circumference that defines a shape contoured to substantially encompass a lower leg of a human, a closure mechanism that is fixed to the sleeve and configured to aid in expansion and compression of at least part of the sleeve and a pocket that is fixed to an outer surface of the sleeve that is configured to house a weapon therein. Upon sealing the closure member, the sleeve will become compressible to a human's lower leg, encompassing the human's calf and ensuring the holster and in turn, weapon will remain in a securely fixed position. The pocket can be sized to accommodate weapons and, in particular, firearms of a variety of shapes and sizes.

In an embodiment, the pocket can extend substantially along the length of the sleeve and can be comprised of an elastomeric material such as neoprene that is breathable.

In an embodiment, the closure mechanism can be a zipper. In an embodiment, the closure mechanism includes a plurality of at least one of buttons, snaps and a hook and loop fastening system.

In an embodiment, the sleeve extends along a longitudinal axis and the pocket has an opening that is angled in relation to the longitudinal axis permitting a firearm to be arranged therein and extend substantially parallel to the longitudinal axis.

In an embodiment, the sleeve extends between a first opening and a second opening with the circumference of the sleeve between the first opening and a portion of the sleeve located substantially between the first opening and the second opening being greater than a circumference at the second opening of the sleeve.

In an embodiment, the holster includes a compartment (e.g., to carry a knife, ammunition, etc.) that is fixed to an outer surface of the sleeve and spaced from the pocket. The compartment can be comprised of an elastomeric material such as neoprene that is breathable. The compartment can be substantially smaller than the pocket and is configured to carry accessories.

In an embodiment, the holster can include a releasably fixable strap that extends about the outer surface of the sleeve and can further aid in securing the sleeve in a desired position.

In an embodiment, the holster can include a plurality of tactile projections that are fixed to an inner surface of the housing.

In an embodiment, the present invention is directed to a holster that is configured to house a weapon. The holster can include a housing that is comprised substantially of an elastomeric material and extends between a first opening and a second opening that is spaced from the first opening and pocket that is fixed to an outer surface of the housing, extends substantially between the first opening and the second opening and is configured to hold the weapon therein. The housing can have a non-uniform shape that is contoured to substantially encompass a lower region of a human leg. The pocket can have an opening that is angled relative to the first opening and the second opening such that when the weapon is arranged therein, the weapon is secured in a fixed position within the pocket.

A closure mechanism can be fixed to the housing and configured to aid in expansion and compression of at least part of the housing. A second pocket can be fixed to the outer surface of the sleeve and spaced from the pocket.

DETAILED DESCRIPTION OF EMBODIMENTS OF THE INVENTION

With reference now to the drawings, and in particular to FIGS. 1 through 7, an embodiment of a holster 10 that is designed to carry a concealed weapon (i.e., a firearm) 12 will be described.

Figure 1:
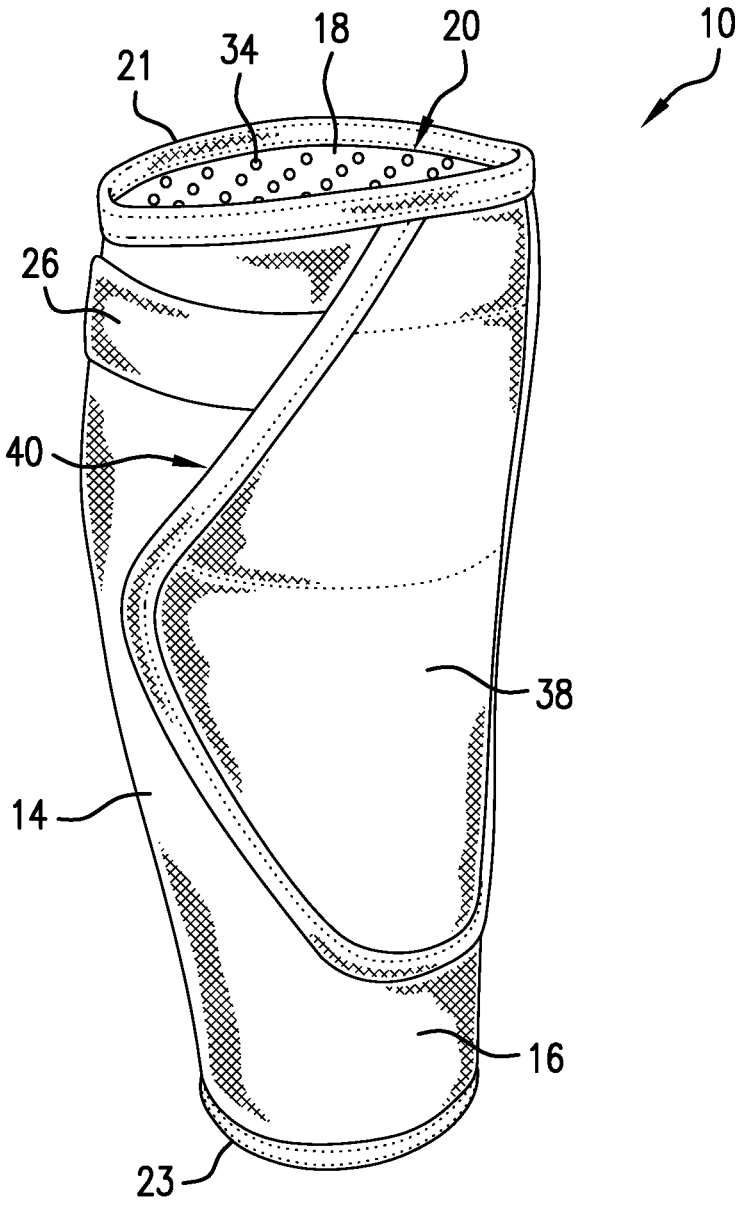
FIG. 1 is a front perspective view of an embodiment of a holster of the present invention designed to carry a concealed weapon.
Figure 2:
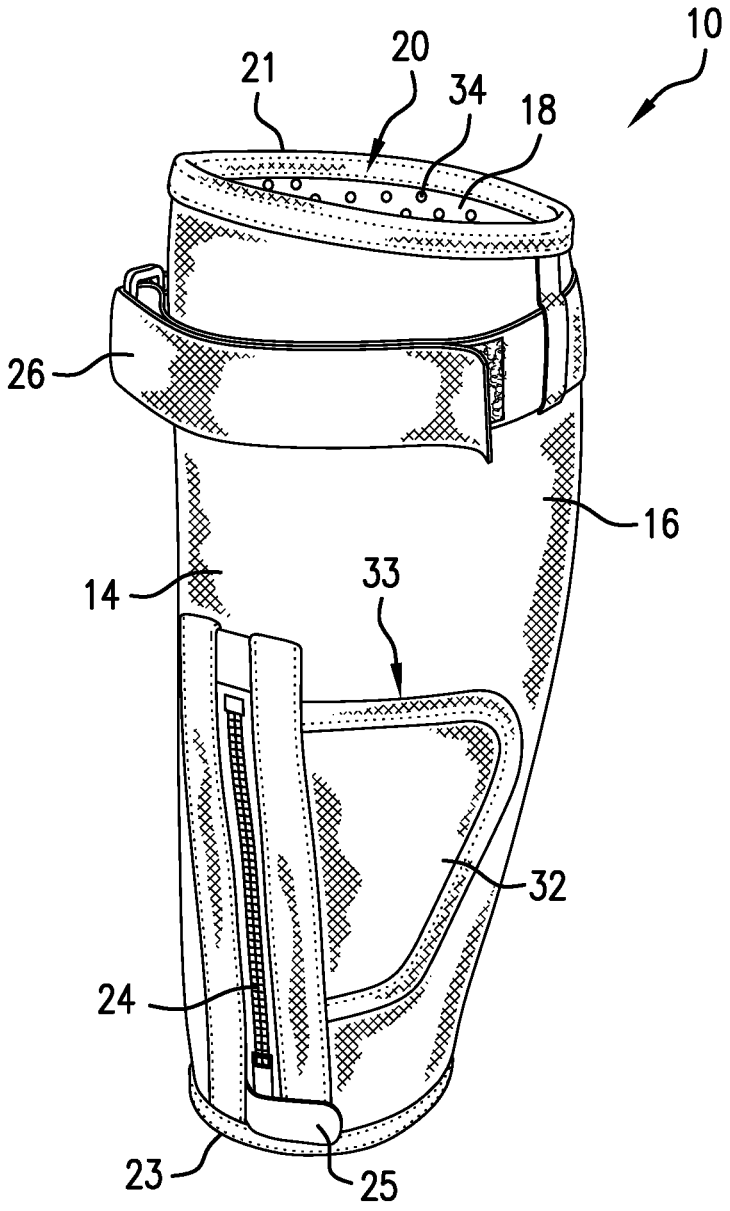
FIG. 2 is a rear perspective view of the holster of FIG. 1.

FIGS. 1 and 2 are a front perspective and rear perspective view, respectively, of the holster 10. The holster 10 includes a sleeve 14 that has an outer surface 16 and an inner surface 18. The sleeve 14 can be comprised of at least one layer of material that has elastomeric properties to allow the sleeve 14 to ergonomically conform to the shape of an individual's lower leg and be compressible when worn by an individual.

In an embodiment, the sleeve 14 can be comprised of neoprene. The neoprene sleeve can be breathable such that an elastomeric layer of the neoprene is arranged between a first and a second outer layer of material includes a plurality of openings.

Figure 3:
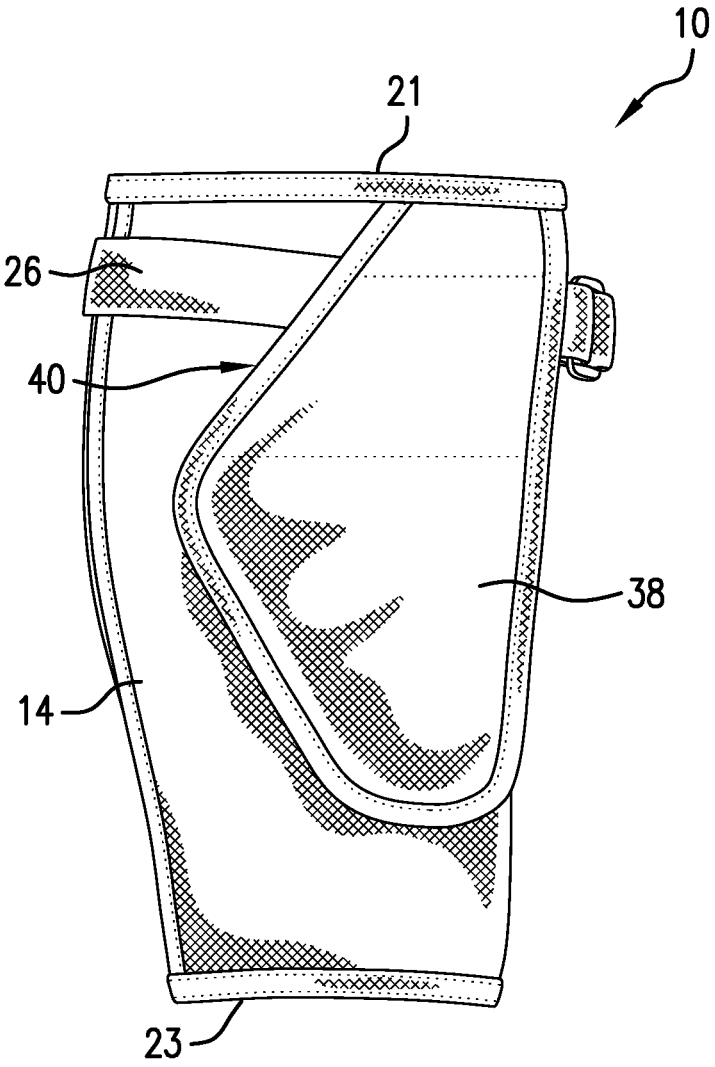
FIG. 3 is a first side view of the holster of FIG. 1.

FIG. 3 depicts a first side view of the holster 10. As can be seen, the sleeve 12 has a shape that contours to fit snuggly around the lower leg of an individual and in particular, over a region that encompasses the individual's calf. The sleeve 14 includes a first opening 20 at a first end 21 thereof and a second opening 22 at a second end 23 thereof. As can be seen in FIGS. 1-3, the sleeve 14 has that has a first outer periphery that extends from the first opening 20 about halfway along the length of the sleeve 14 and then tapers toward a the second opening 22 such that the sleeve 14 has a second outer periphery at the second opening 22. To aid in arranging the holster 10 on around an individual's lower leg and removing the holster 10 therefrom, the holster 10 includes a closure mechanism 24 that extends approximately from the second opening 22 to the region of the sleeve 14 located about midway between the first opening 20 and the second opening 20. The closure mechanism 24 allows the tapered region of the sleeve 14 to expand so that an individual can easily slide the holster 10 over their foot, past their ankle and over their calf. Once the holster 10 is in place around the lower leg of the individual, the closure mechanism 24 can be sealed to create a form fit of the sleeve 14 around the individual's lower leg.

As shown in FIGS. 1, 2, 3 and 4, the closure mechanism 24 is a zipper that can be unzipped (See FIG. 4) so that an individual can easily slide the sleeve 14 in position at a lower region of the individual's leg and around their calf and then, once the sleeve 14 is orientated in a desired position, the sleeve 14 is zipped to achieve a compression fit to secure the holster 10 to the individual's body. The closure mechanism 24 can include a fastener 25 that extends over the closure mechanism 24 to both secondarily secure the sleeve 14 at a closed position to an individual's lower leg and to extend over the closure mechanism 24 to aid in preventing the closure mechanism 24 form opening. Although a zipper is shown herein, the closure mechanism 24 can be any fastening mechanism including, but not limited to, a plurality of buttons, snaps and a hook and loop fastening system.

By designing the sleeve 14 to encompass the natural contour of an individual's lower leg, including one's calf, between the knee and ankle, the holster 10 allows for little to no discomfort while being capable of remaining concealed whether the individual is in a stationary position or moving. Additionally, because the holster 10 typically fits substantially over the entire calf region of an individual's lower leg, the weight of the weapon 12 can be evenly distributed, obviating the need for any additional support of the weapon 12.

To provide further support, the holster 10 can include an adjustable strap 26 that extends around the sleeve 14, near the first opening 20. The strap 26 can be secured to itself by any fastening system, including a loop and hook fastening system. To secure the strap 26 to the sleeve 14, loops 28 are fixed to the sleeve 14 through which the strap 26 extends. The strap 26 includes buckle 30 to allow for adjustability to accommodate the circumference of a variety of individual's lower legs.

As shown in FIGS. 1 and 3, the holster 10 can include a first pocket or compartment 32 that has an opening 33 is fixed (e.g., sewn) to a region of the sleeve 14 near the closure mechanism 24. The first pocket 32 can be comprised of an elastomeric material (e.g., neoprene) and can be used, for example, to carry accessories (e.g., ammo).

Figure 4:
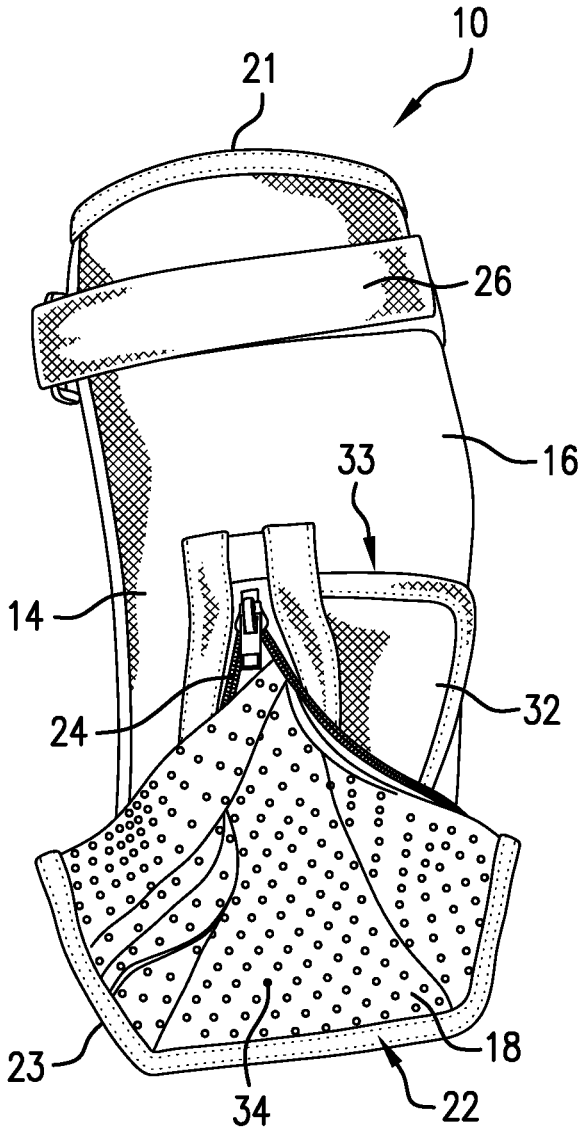
FIG. 4 shows the first side view in a partially unzipped state.

The sleeve 14 can include a tactile coating 34 over a surface of the inner surface 36 of the sleeve 14. As shown in FIG. 4, the tactile coating 34 can be a plurality of polymeric projections that have a high coefficient of friction to aid in preventing slippage of the sleeve 14 during movement.

Figure 5:
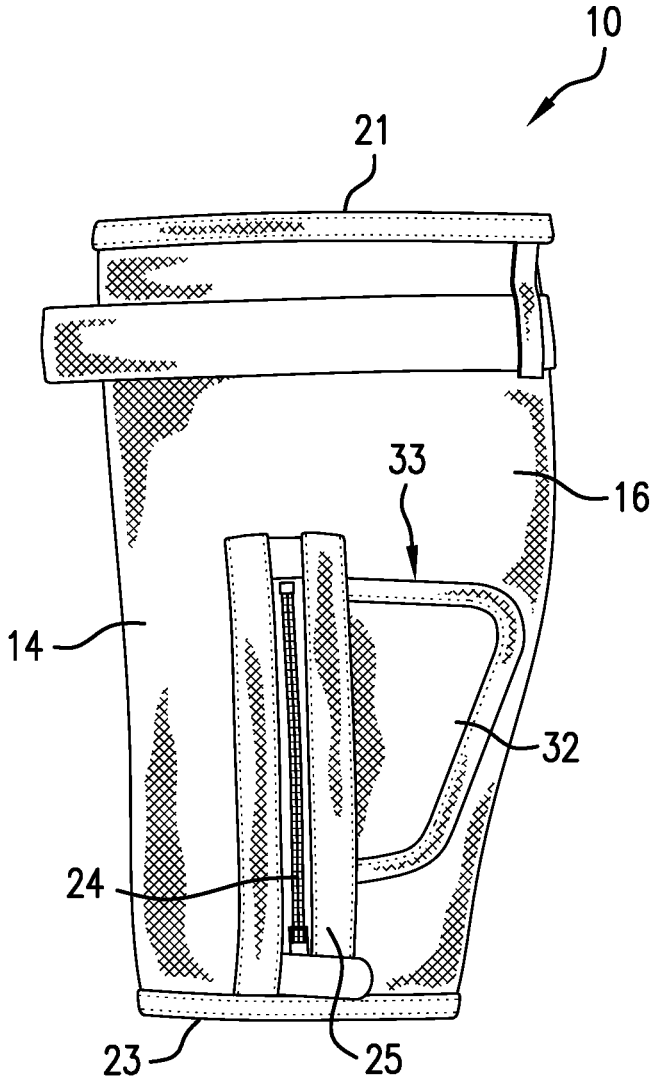
FIG. 5 is a second side view of the holster of FIG. 1.
Figure 6:
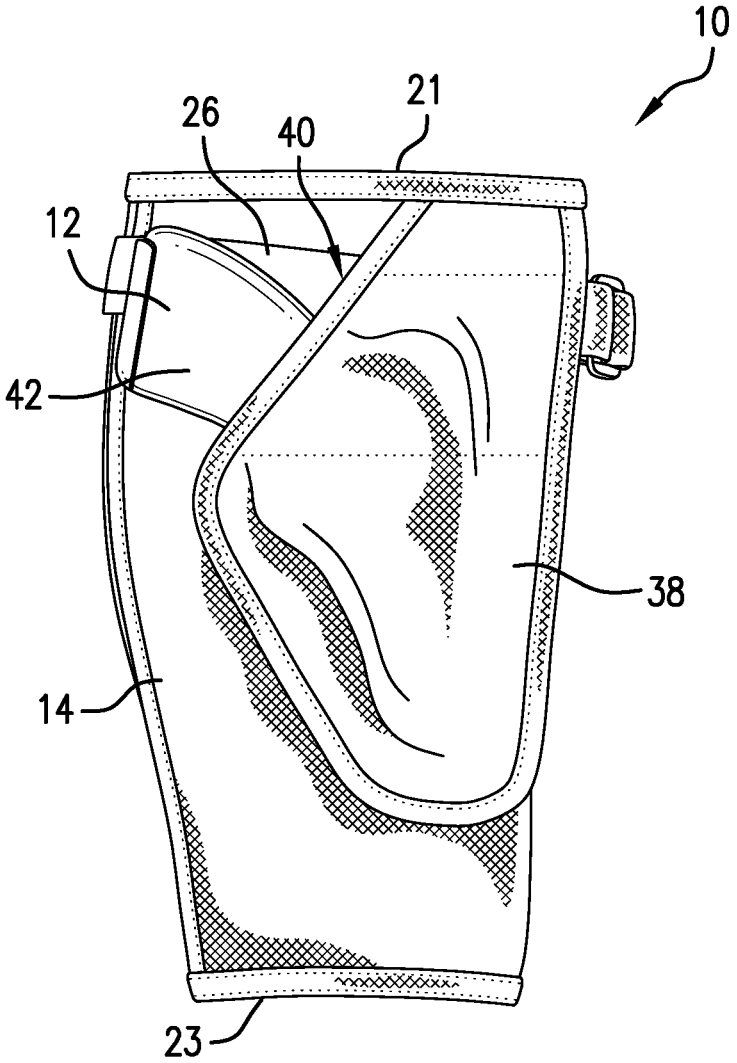
FIG. 6 shows a firearm housed in the holster.

FIGS. 5 and 6 illustrate a second side of the holster 10 that includes a second compartment 38 that is fixed (e.g., sewn) to the sleeve 14. The second compartment 38 can house the firearm 12 and, as illustrated in FIGS. 5 and 6, can extend substantially along the length of the holster 10, allowing the firearm 12, depending on the size and shape of the firearm 12, to extend substantially along the side of an individual's lower leg. As such, a garter or other mechanism is not required to support the firearm 12 while ensuring the second compartment 38 is configured accommodate a variety of firearms of different shapes and sizes (i.e., the compartment 38 allows for universal use with firearms).

Figure 7:
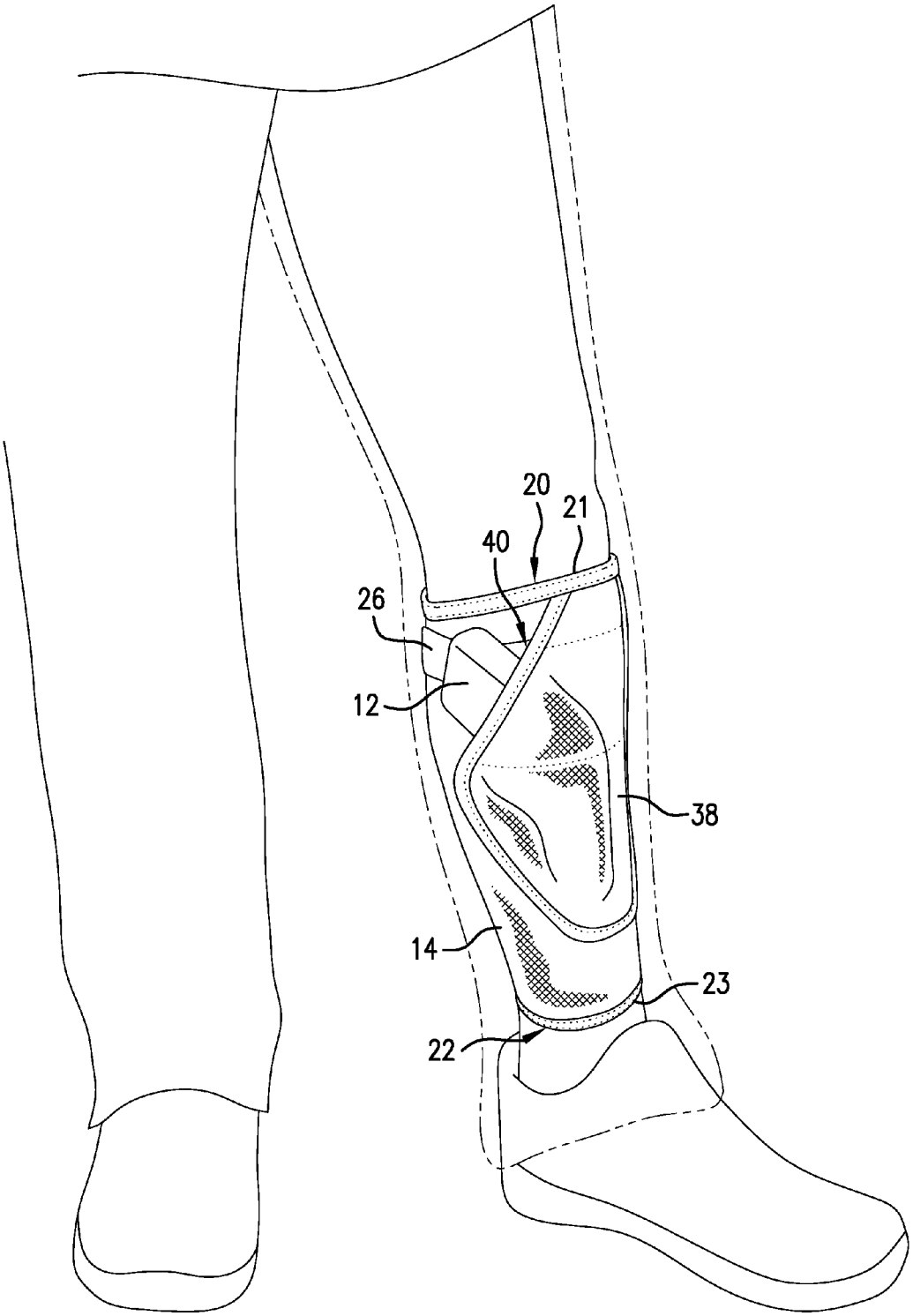
FIG. 7 shows the holster with a firearm housed therein secured to an individual.

Additionally, in an embodiment, the second compartment 38 can be made of an elastomeric material so that the firearm 12 can be securely arranged therein and in secure contact with an individual's lower leg ensuring easy removal of a firearm (See FIG. 7). As shown in FIGS. 5-7 the second compartment 38 is substantially enclosed and includes an opening 40 that is canted such that grip 42 of a firearm 12 can extend out of the second compartment 38, toward an individual's calf or the rear of an individual's knee when the holster 10 is secured in place on an individual's leg. This allows for easy and quick access to remove the firearm 12 from the holster 10 (e.g., no additional fastener is required) and to insert the firearm 12 into the holster 10 as well.

Although this invention has been disclosed in the context of certain embodiments and examples, it will be understood by those skilled in the art that the invention extends beyond the specifically disclosed embodiments to other alternative embodiments and/or uses of the invention and obvious modifications and equivalents thereof. It is to be understood that the phraseology or terminology employed herein is for the purpose of description and not of limitation. In addition, while several variations of the embodiments of the invention have been shown and described in detail, other modifications, which are within the scope of this invention, including, but not limited to, the substitutions of equivalent features, materials, or parts, will be readily apparent to those of skill in the art based upon this disclosure without departing from the spirit and scope of the invention.

What is claimed is:

1. A holster, comprising:

a sleeve delimited at a first end and a second end and including a sidewall extending substantially about an axis between the first end and the second end, the sidewall having a non-uniform perimeter defining a shape contoured to substantially encompass a lower region of a human leg;

a closure mechanism fixed to the sleeve and extending longitudinally along the axis between the first end and the second end of the sleeve; and a pocket fixed to an outer surface of the sleeve that is configured to house a weapon therein extending between the first end of the sleeve and a region of the sidewall of the sleeve that is spaced from the second end of the sleeve, wherein the pocket is delimited at an outer periphery by a first segment, a second segment extending contiguous to the first segment at a first angle from the first segment, a third segment extending contiguous to the second segment at a second angle from the second segment, a fourth segment extending contiguous to the third segment at a third angle from the third segment and a fifth segment extending contiguous to and between the fourth segment and the first segment at a fourth angle.

2. The holster of claim 1, wherein the sleeve is comprised of an elastomeric material.

3. The holster of claim 2, wherein the sleeve is comprised of breathable neoprene material.

4. The holster of claim 1, wherein the pocket is comprised of an elastomeric material.

5. The holster of claim 4, wherein the pocket is comprised of breathable neoprene material.

6. The holster of claim 1, wherein the closure mechanism is a zipper.

7. The holster of claim 1, wherein the closure mechanism includes a hook and loop fastening system.

8. The holster of claim 1, wherein the pocket has a single opening that extends from the first end of the sleeve at an angle in relation to the axis toward the second end of the sleeve, such that the weapon arrangeable therein is substantially parallel to the longitudinal axis.

9. The holster of claim 1, wherein the sleeve has a circumference between the first end and a portion of the sleeve located substantially midway between the first end and the second end being greater than a circumference at the second end of the sleeve.

10. The holster of claim 1, further comprising a compartment that is spaced from the pocket and fixed to the sleeve adjacent to the closure mechanism, between the first end and the second end of the sleeve.

11. The holster of claim 10, wherein the compartment is comprised of an elastomeric material.

12. The holster of claim 11, wherein the compartment is comprised of breathable neoprene material.

13. The holster of claim 1, further comprising a releasably fixable strap extending about the outer surface of the sleeve that is configured to aid in securing the holster to the lower region of the human leg.

14. The holster of claim 1, further comprising a plurality of tactile projections fixed to an inner surface of the sleeve.

15. A holster configured to house a weapon, the holster comprising:

a housing comprised substantially of an elastomeric material and including a sidewall that extends substantially about a longitudinally extending axis between a first end having a first opening and a second end having a second opening that is spaced from the first opening; and a pocket that is configured to house the weapon therein fixed to an outer surface of the housing and extending substantially between the first opening and the second opening and the pocket including a single opening extending continuously, in a single direction, from the first end of the housing at an angle in relation to the axis toward the second end of the housing, wherein the pocket is delimited at an outer periphery by a first segment, a second segment extending contiguous to the first segment at a first angle from the first segment, a third segment extending contiguous to the second segment at a second angle from the second segment, a fourth segment extending contiguous to the third segment at a third angle from the third segment and a fifth segment extending contiguous to and between the fourth segment and the first segment at a fourth angle.

16. The holster of claim 15, further comprising a closure mechanism fixed to the housing and configured to aid in expansion and compression of at least part of the housing.

17. The holster of claim 15, further comprising a second pocket that is fixed to the outer surface of the sleeve and spaced from the pocket.

18. The holster of claim 15, wherein the housing has a non-uniform shape that is contoured to substantially encompass a lower region of a human leg.

* * * * *